US009758956B2

(12) United States Patent
Oberholzer et al.

(10) Patent No.: US 9,758,956 B2
(45) Date of Patent: Sep. 12, 2017

(54) FLUSHING DEVICE

(71) Applicant: GEBERIT INTERNATIONAL AG, Jona (CH)

(72) Inventors: Roland Oberholzer, Uster (CH); Maarten Roest, Jona (CH); Daniel Raissle, Altendorf (CH)

(73) Assignee: GEBERIT INTERNATIONAL AG, Jona (CH)

( * ) Notice: Subject to any disclaimer, the term of this patent is extended or adjusted under 35 U.S.C. 154(b) by 128 days.

(21) Appl. No.: 14/685,828

(22) Filed: Apr. 14, 2015

(65) Prior Publication Data

US 2015/0299996 A1 Oct. 22, 2015

(30) Foreign Application Priority Data

Apr. 16, 2014 (EP) ..... 14164913

(51) Int. Cl.
*E03D 5/10* (2006.01)
*E03D 13/00* (2006.01)
*E03D 1/34* (2006.01)

(52) U.S. Cl.
CPC ..... *E03D 5/105* (2013.01); *E03D 1/34* (2013.01); *E03D 13/00* (2013.01)

(58) Field of Classification Search
CPC ..... E03D 5/105; E03D 5/10; E03D 13/005; E03D 1/34; E03D 13/00
See application file for complete search history.

(56) References Cited

U.S. PATENT DOCUMENTS

| | | | | |
|---|---|---|---|---|
| 5,054,132 | A | 10/1991 | Bartella | |
| 5,206,961 | A * | 5/1993 | Ruegg | E03D 13/00 248/284.1 |
| 8,185,977 | B2 * | 5/2012 | Seibt | B64D 11/02 4/305 |
| 2003/0167561 | A1 * | 9/2003 | Nilsson | E03D 13/00 4/301 |

FOREIGN PATENT DOCUMENTS

| | | |
|---|---|---|
| DE | 91 08 260 U1 | 9/1991 |
| DE | 41 20 768 A1 | 1/1993 |
| EP | 0 348 864 A1 | 1/1990 |
| EP | 0 487 449 A1 | 5/1992 |
| EP | 1 340 861 A1 | 9/2003 |

OTHER PUBLICATIONS

European Search Report of corresponding European Patent Application No. 14 16 4913 dated Oct. 15, 2014.

* cited by examiner

*Primary Examiner* — Janie Loeppke
(74) *Attorney, Agent, or Firm* — Sughrue Mion, PLLC

(57) ABSTRACT

A flushing device for a urinal comprises a connection unit and a control unit, wherein the connection unit can be fixed to the urinal and the control unit can be connected to the connection unit via an interface. The connection unit comprises a connection pipe with an inlet, for connection to a mains system, and an outlet, a flushing pipe with an inlet and an outlet for connection to a nozzle arrangement for discharging flushing water into the urinal bowl of the urinal, and a support element on which the outlet of the connection pipe and the inlet of the flushing pipe are mounted in a fixed position. The control unit comprises a support element on which are arranged at least one control element, a pipe section with an inlet and an outlet and a flushing valve, which is arranged between the inlet and outlet and has a power-supply element.

20 Claims, 5 Drawing Sheets

FLUSHING DEVICE

TECHNICAL FIELD

The present invention relates to a flushing device for a urinal according to claim 1 and to a urinal according to claim 13.

PRIOR ART

In urinals, the elements provided for flushing purposes are arranged typically between the urinal and the wall on which the urinal is installed. For example, such an arrangement is disclosed in EP 1 340 861. In the case of maintenance, it is necessary, for example in the case of a flushing valve being changed over, for the urinal to be separated from the wall. This gives rise to a very great amount of effort, on the part of the fitter.

The prior art has disclosed further urinals which provide for straightforward maintenance. For example, reference is made to DE 41 20 768, which discloses a urinal which has a removable panel on the upper periphery. The panel is directly visible to the user, which is disadvantageous in respect of acts of vandalism.

DESCRIPTION OF THE INVENTION

Proceeding from the prior art, it is an object of the invention to specify a urinal of which the flushing device is easily accessible and interchangeable. In particular, the maintenance and/or servicing of the flushing device should be as straightforward as possible. Furthermore, the flushing device, in accordance with a sub-aspect of the invention, should be designed to be, as far as possible, vandal-safe.

This object is achieved by a flushing device for a urinal according to claim 1. Accordingly, a flushing device for a urinal comprises a connection unit and a control unit, wherein the connection unit can be fixed to the urinal and the control unit can be connected to the connection unit via an interface. The interface establishes, for flushing-triggering purposes, a functional contact between the control unit and the connection unit. The connection unit comprises a connection pipe with an inlet, for connection to a mains system, and an outlet, also comprises a flushing pipe with an inlet and an outlet for connection to a nozzle arrangement for discharging flushing water into the bowl of the urinal, and further comprises a support element on which the outlet of the connection pipe and the inlet of the flushing pipe are mounted in a fixed position. The inlet and outlet are thus connected in a specific position to the support element. The connection unit can be connected to the urinal by the support element of the connection unit. The control unit comprises a support element on which are arranged at least one control element, a pipe section with an inlet and an outlet and also a flushing valve, which is arranged between the inlet and outlet and has a power-supply element. The control element and the pipe section are fixed to the support element or are part of the same. The control element provides the flushing valve with a control signal for opening and/or closing the same. The said interface is provided by the outlet of the connection pipe and by the inlet of the flushing pipe, on the part of the connection unit, and by the inlet and the outlet of the pipe section, on the part of the control unit, wherein the inlet of the pipe section can be connected to the outlet of the connection pipe, and the outlet of the pipe section can be connected to the inlet of the flushing pipe.

Providing a connection unit and a control unit each with a corresponding support element gives the advantage that the control unit, which is designed such that it can be separated from the connection unit via the interface, can be separated straightforwardly from the connection unit. This makes it possible, in the case of inspection, for example in the case of the flushing valve being defective, for the entire control unit to be changed over. There is no need for laborious removal of a defective element of the control unit and laborious installation of a functional element.

The interface, in addition, has the advantage that the media connections can be separated straightforwardly, which results in straightforward maintenance of the functional unit.

The outlet of the connection pipe, the inlet of the flushing pipe, and the inlet and the outlet of the pipe section preferably run parallel to one another. Furthermore, the distance between the outlet of the connection pipe and the inlet of the flushing pipe is equal to the distance between the inlet and the outlet of the pipe section. The outlet or the inlet, in this context, is understood to be a part of the pipe section or of the connection pipe, respectively, which extends axially from the pipe opening.

The flushing device preferably comprises a securing element, by means of which the control unit can be arrested mechanically in relation to the connection unit. The securing element thereby provides a stop which prevents the control unit from being separated accidentally from the connection unit.

It is particularly preferred for the securing element to be a securing lever which is mounted on the connection unit or on the control unit and to have at least one receiver, which interacts with at least one pin arranged on the other unit. The control unit can be secured in relation to the connection unit via the interaction between the receiver and pin.

It is particularly preferred for the said receiver to have a curved track which, upon actuation of the securing lever, subjects the control unit to an installation force, and therefore said control unit can be connected to the connection unit. The interaction between the curved track and pin allows the control unit to be moved in the direction of the connection unit upon actuation of the securing lever.

It is particularly preferred for the securing element to comprise an arresting element, by means of which the securing element can be secured in an arresting position. As a result, the securing element is prevented from moving automatically out of the arresting position, which would be disadvantageous for the connection between the connection unit and control unit.

The connection unit advantageously further comprises a power-supply cable with an electrical plug-in connector, wherein the plug-in connector is fastened on the support element. Furthermore, the control unit likewise comprises a plug-in connector for electrical connection to the plug-in connector of the connection unit, wherein the plug-in connectors run parallel to the outlet of the connection pipe, the inlet of the flushing pipe and/or to the outlet of the pipe section.

The connection pipe advantageously comprises a nonreturn valve which, upon removal of the control unit, is closed by a spring pressure. This does away with the need for any further manipulation, for example the closure of a water tap in the connection pipe.

The outlet of the connection pipe and the inlet of the pipe section preferably have a coupling, and/or the inlet of the flushing pipe and the outlet of the pipe section have a coupling, the respective parts being connected to one another via said couplings. The coupling provides the interface. The coupling may be, for example, a quick-action closure.

The coupling or the interface preferably comprises in each case two pipe sections assigned to the elements which are to be connected, wherein one of the pipe sections projects into the other pipe section. A respective sealing ring is arranged between the pipe sections. The inlet and the outlet connected to the inlet are thus in the form of pipe sections.

The pipe section and the flushing valve are preferably arranged on an upper side of the support element and the control element is arranged on an underside of the support element. The arrangement in the urinal may thus be such that the upper side is directed towards the interior of the urinal and that the underside forms part of an outer wall of the urinal, wherein the control element then projects beyond the outer wall and can detect a user. This increases the level of safeguarding against vandalism, because it is only the parts which are important for detecting a person which project out of the urinal.

The power-supply element is preferably a battery or a power-supply unit. The power-supply unit is connected to the connection cable. As an alternative, it is also possible for the power-supply element to be a turbine arranged in the pipe section.

The support element of the connection unit preferably comprises a fastening element, via which the connection unit can be connected to the urinal.

A urinal arrangement comprises a urinal having a urinal bowl and a cavity, and also comprises a flushing device according to the description above, wherein the flushing device is arranged, at least in part, in the cavity.

The said cavity of the urinal is accessible via an inspection opening which, in the installed position, is located preferably beneath the urinal bowl, wherein a lower periphery of the inspection opening, in the installed position, is located preferably in the horizontal. The inspection opening is located such that a user cannot readily see it, which, once again, is an advantage for safeguarding against vandalism.

The connection unit is preferably fixed to the urinal, and the control unit is connected in an interchangeable manner to the connection unit. In a particularly preferred development, there is no connection between the control unit and the urinal. The control unit is connected exclusively to the connection unit.

With the control unit installed, the control element preferably projects out of the inspection opening. In this embodiment, the control element is preferably a detecting sensor, which detects the person in front of the toilet or the urinal and then provides a control signal for the flushing valve.

As an alternative, it is also possible for the control element to be a time-control means which provides a control signal for the flushing valve at predetermined time intervals.

Further embodiments are specified in the dependent claims.

BRIEF DESCRIPTION OF THE DRAWINGS

Preferred embodiments of the invention will be described hereinbelow with reference to the drawings, which serve merely for explanatory purposes and should not be interpreted in any limiting sense. In the drawings.

DESCRIPTION OF PREFERRED EMBODIMENTS

Figure 1:
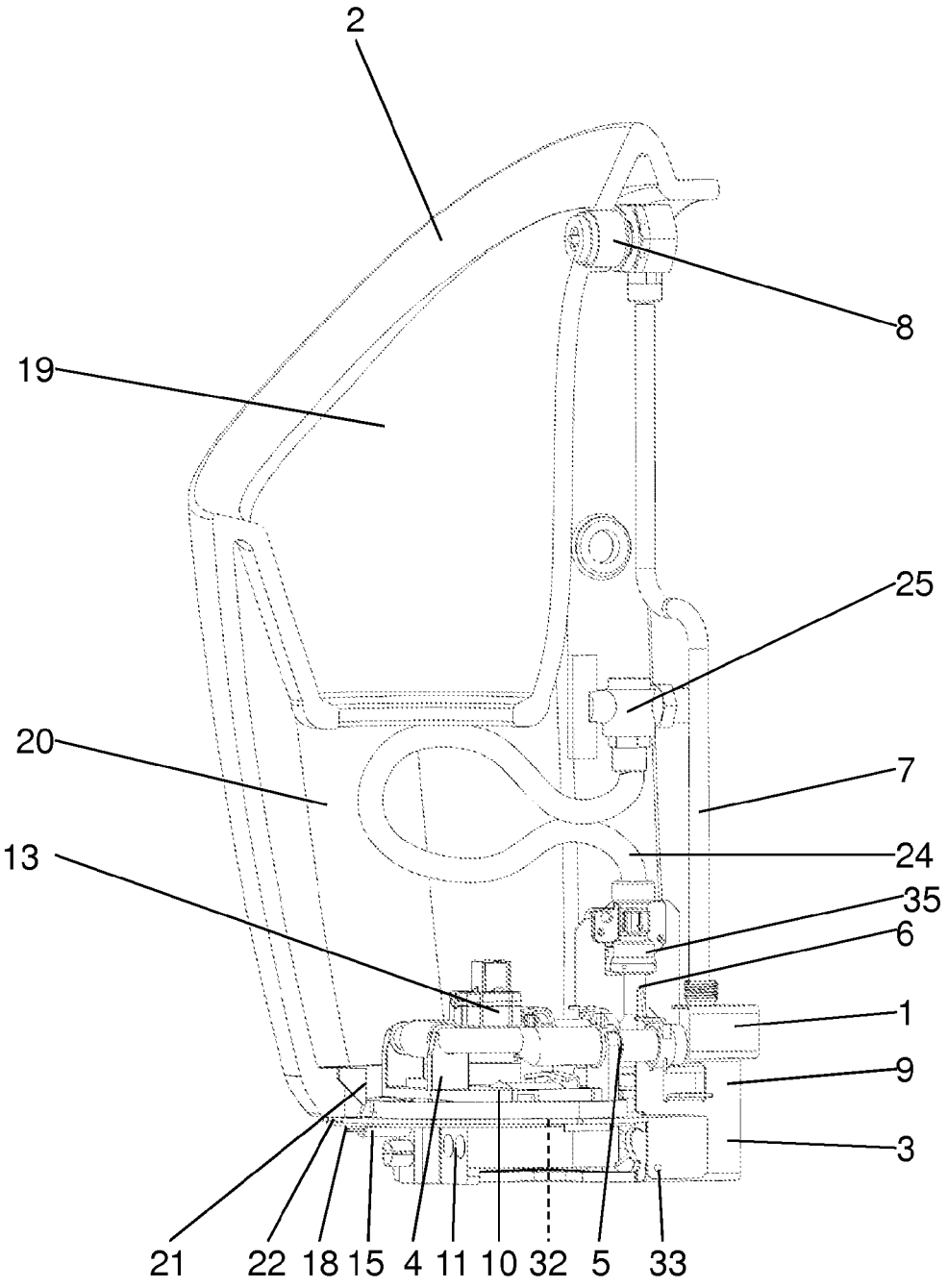
FIG. 1 shows a perspective view of a urinal according to the invention, the urinal being illustrated partly in section.
Figure 2:
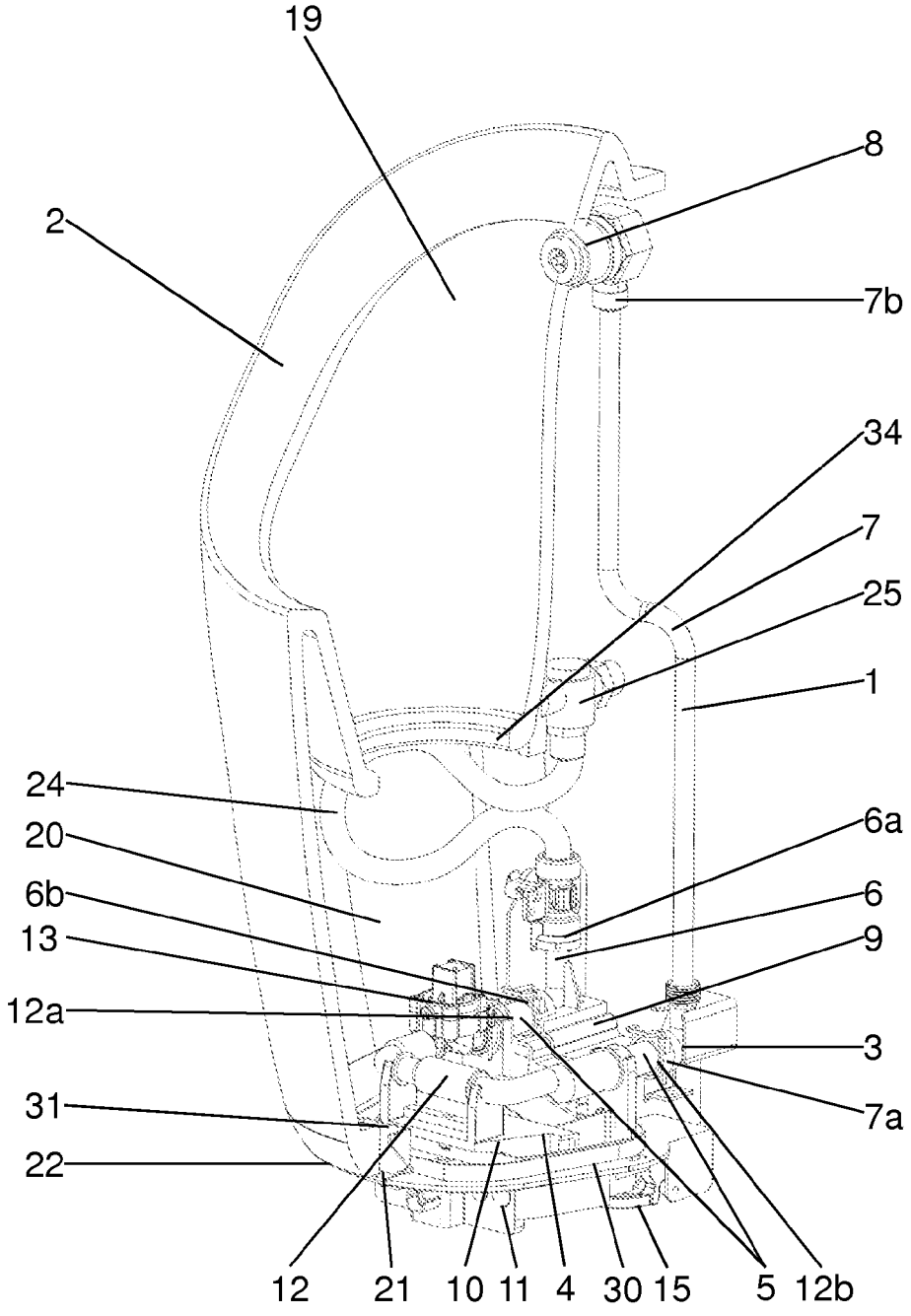
FIG. 2 shows the urinal according to FIG. 1 in a different position.
Figure 3:
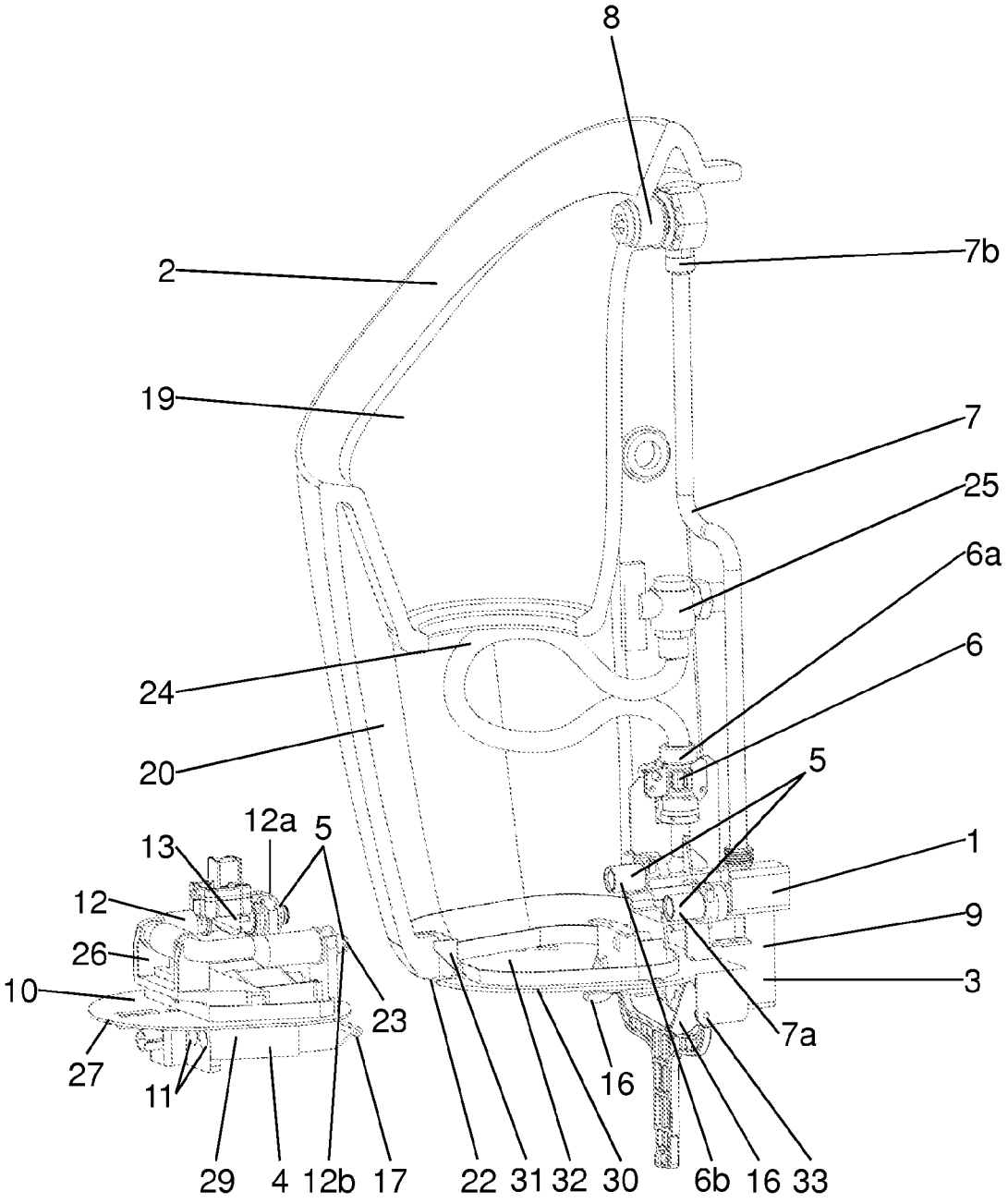
FIG. 3 shows the urinal according to FIGS. 1 and 2 during inspection.

FIGS. 1 to 3 show perspective views, in section, of a urinal 2 having a flushing device 1 for supplying flushing water into the urinal bowl 19. The flushing device 1 comprises a connection unit 3 and a control unit 4. The connection unit 3 can be fixed to the urinal 2, while the control unit 4 can be connected to the connection unit 3.

Figure 4:
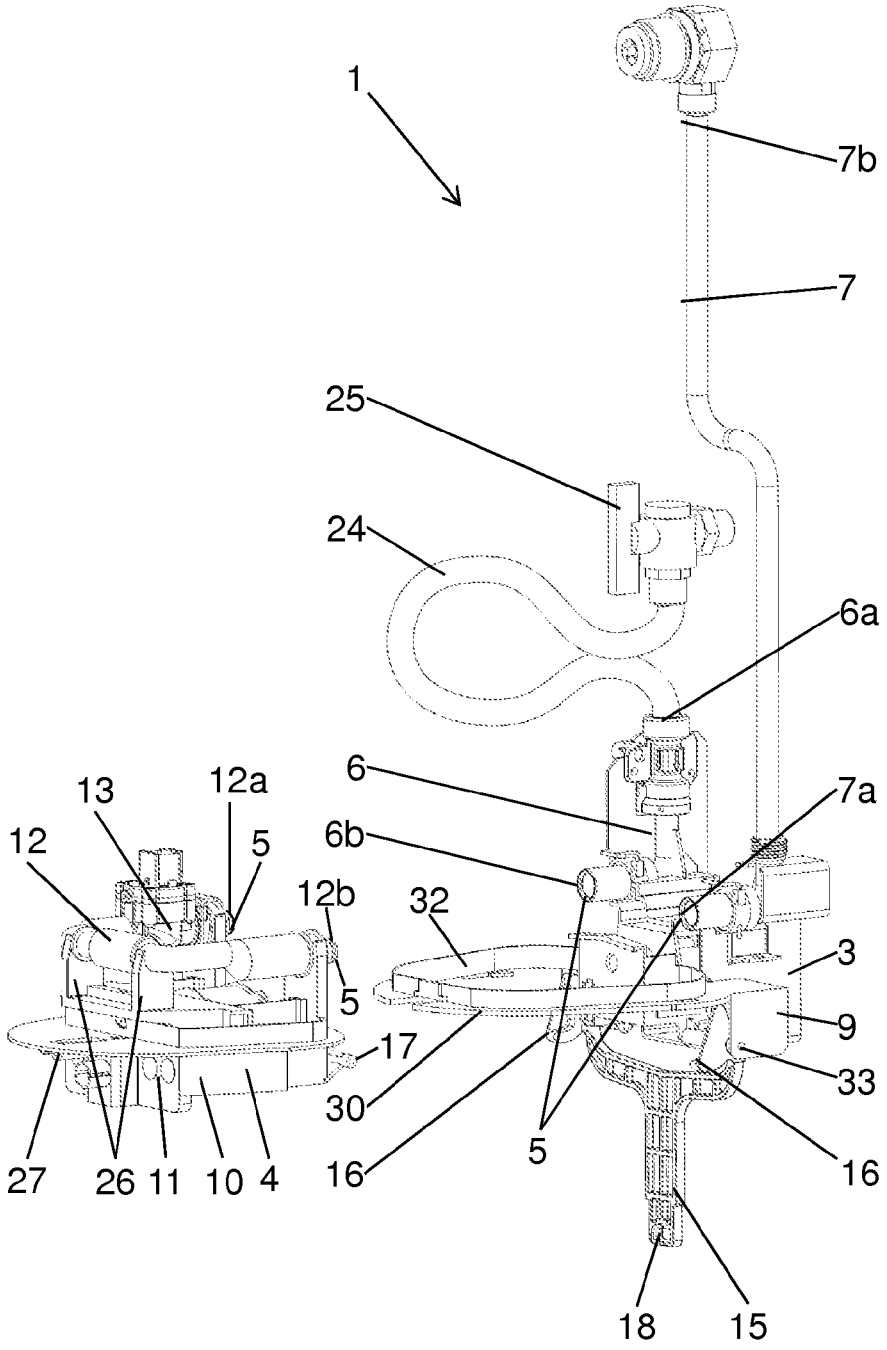
FIG. 4 shows the flushing device with connection unit and pipepipes and also the control unit according to the preceding figures.

In FIGS. 1 and 2, the control unit 4 is fixed to the connection unit 3. The control unit 4 can be connected to the connection unit 3 via an interface 5. The interface 5 may be, for example, a coupling. FIG. 3 shows the control unit 4 in a state in which it has been removed from the connection unit 3. FIG. 4 then shows the connection unit 3 and the control unit 4, likewise in the removed state, without the urinal 2.

The connection unit 3 comprises, as shown in FIGS. 1 to 4, a connection pipe 6 with an inlet 6*a*, for connection to a mains system, and an outlet 6*b*. The inlet 6*a* here is connected to a hose 24, which is connected to the mains system via a stop valve 25 and/or a restrictor 35. The restrictor 35 is advantageously accessible via an opening in the urinal and can be actuated without the urinal being removed. The restrictor 35 can block the inflow fully. As an alternative, the inflow can also be interrupted by virtue of the stop valve 25 being actuated. The connection unit 3 further comprises a flushing pipe 7 with an inlet 7*a* and an outlet 7*b* for connection to a nozzle arrangement 8, via which flushing water can be discharged into the urinal bowl 19 of the urinal 2. The connection unit 3 comprises, as its central element, a support element 9 on which the outlet 6*b* of the connection pipe 6 and the inlet 7*a* of the flushing pipe 7 are mounted in a fixed position. The outlet 6*b* and the inlet 7*a* are thus fixed to the support element 9. Depending on the design of the support element 9, it is also possible for these parts to be formed integrally on the support element 9, this then giving rise to a single-piece structure.

The control unit 4 comprises, as shown in FIGS. 1 to 4, a support element 10 on which are firmly mounted at least one control element 11, a pipe section 12 with an inlet 12*a* and an outlet 12*b* and also a flushing valve 13, which is arranged between the inlet 12*a* and the outlet 12*b* and has a power-supply element 14. The support element 10 serves as a mounting element for the parts arranged on the support element 10, that is to say the at least one control element 11, the pipe section 12 and the flushing valve 13 with the power-supply element 14. The pipe section 12 with the inlet 12*a* and the outlet 12*b* is thereby mounted firmly on the support element 10. The support element 10 has appropriate mounting elements 26 for this purpose. The mounting elements 26 here are mounting crosspieces, which project away from the support element 10.

Mounting the said elements on the support element 10 gives a control unit 4 designed essentially in the form of a single piece or element. This makes it possible for the entire control unit 4 to be changed over. There is therefore no need for the fitter to change over individual parts which are relevant to the control means, but rather the entire control unit 4 can be changed over.

The flushing valve 13 is arranged in the pipe section 12 and interrupts the water flow between the connection pipe 6 and the flushing pipe 7 or frees the path, in the event of a flushing operation, for the flushing water.

The said interface 5 between the control unit 4 and the connection unit 3 is provided by the outlet 6*b* of the connection pipe 6 and by the inlet 7*a* of the flushing pipe 7, on the part of the connection unit 3, and by the inlet 12*a* and the outlet 12*b* of the pipe section 12, on the part of the control unit 4. If the control unit 4 is connected to the connection unit 3, there is a mechanical and fluidic contact between the outlet 6*a* of the connection pipe 6 and the inlet 12*a* of the pipe section and between the inlet 7*a* of the flushing pipe 7 and the outlet 12*b* of the pipe section 12. The said inlets and outlets may comprise couplings as an interface.

As can be seen to good effect from the figures, the outlet 6*a* of the connection pipe 6, the inlet 7*a* of the flushing pipe 7, and the inlet 12*a* and the outlet 12*b* of the pipe section 12 each run parallel to one another. The distance between the outlet 6*b* of the connection pipe 6 and the inlet 7*a* of the flushing pipe 7 is thereby equal to the distance between the inlet 12*a* and the outlet 12*b* of the pipe section 12.

The inlets 7*a*, 12*a* and the outlets 6*b*, 12*b* are provided by pipe sections of corresponding design in each case. These pipe sections run parallel, and at the said distance apart, in the region of the interface. It may also be said here that the pipe section which provides the outlet 6*b* and the pipe section which provides the inlet 12*a* run coaxially in relation to one another. The same can be said for the pipe section which provides the outlet 12*b* and the pipe section which provides the inlet 7*a*.

The flushing device 1 further comprises a securing element 15, by means of which the control unit 4 can be arrested or secured mechanically in relation to the connection unit 3. The securing element 15 may be of any desired design. For example, the securing element 15 may be a latching-in connection or a threaded connection.

The securing element 15, in the embodiment shown in the figures, is a securing lever 15 which is mounted in a pivotable manner on the connection unit 3. The securing lever 15 is mounted on the support element about a bearing location 33. In another embodiment (not shown here), it is also possible for the securing lever 15 to be mounted on the control unit 4. The securing lever 15 has at least one receiver 16—in this case two spaced-apart receivers 16 are provided—which interacts with at least one pin 17 arranged on the control unit—likewise two pins 17 are provided here. In the case of the securing element 15 being pivoted, the receiver 16 grips the pin 17 and thus secures the control unit 4 in relation to the connection unit 3. The receiver 16 preferably has a curved track which, upon actuation of the securing lever 15, subjects the control unit 4 to an installation force, and therefore the control unit 4 along with the connection unit 3, upon actuation of the securing lever 15, is pushed into the connection unit 3.

The securing element 15 preferably comprises an arresting element 18, by means of which the securing element 15 can be secured in an arresting position. The arresting element 18 here is arranged at the front end of the securing lever 15. The arresting element 18 here interacts with a receiver 27 assigned to the control unit 4. The arresting element 18 and the receiver 27 can be connected to one another preferably via a latching connection. The latching connection here is designed such that a fitter can actuate it without any tools being required. It is also possible however, in particular for use in public areas, for the latching connection to be designed such that the fitter has to operate it with a certain tool in order to be able to release the connection between the arresting element 18 and the receiver 27.

In respect of the different positions of the securing lever 15, reference is made to FIGS. 3 and 4 and to FIGS. 1 and 2. In FIGS. 1 and 2, the securing lever 15 is located in the arresting position. In FIGS. 3 and 4, the securing lever 15 is located in the release position, in which the control unit 4 can be separated from the connection unit 3.

The connection pipe 6 preferably contains a nonreturn valve which, upon removal of the control unit 4, is closed by a spring pressure. It is thus possible for the control unit 4 to be separated from the connection unit 3 without any further manipulation in respect of water flow having to be implemented in the connection pipe 6. In particular, there is no need for the stop valve 25 to be actuated. This results in particularly efficient change over of the control unit 4 from the connection unit 3. If the restrictor 35 is accessible from the outside through the wall of the urinal, it can be closed by the fitter prior to the control unit 4 being removed. In other words, in a first step, the inflow of water is stopped by virtue of the restrictor 35 being actuated and then, in a second step, the entire control unit 4 is removed.

The outlet 6*a* of the connection pipe 6 and the inlet 12*a* of the pipe section 12, and the inlet 7*a* of the flushing pipe 7 and the outlet 12*b* of the pipe section 12, respectively, have respective couplings. The respective parts can be connected to one another via said couplings. The couplings are preferably plug-in couplings. In general terms, it can be said that the coupling comprises in each case two pipe sections assigned to the elements which are to be connected, that is to say the inlets and outlets, wherein one of the pipe sections projects into the other pipe section, and wherein a sealing ring 23 is arranged between the pipe sections and correspondingly seals the annular gap between the pipe sections.

In respect of the support element 10, the pipe section 12 and the flushing valve 13 are arranged on an upper side of the support element 10. The control element is preferably a detecting sensor 11. The detecting sensor 11 is arranged on an underside 29 of the support element 10. The detecting sensor 11 is connected to the flushing valve 13 and actuates the latter as soon as the detecting sensor 11 detects a person using the urinal facility. The arrangement on the upper side 28 and on the underside 29 of the support element 10 has the advantage that the flushing valve 13 and the pipe section 12, in the installed state, are located in the cavity of the urinal, while the detecting sensor 11, in the installed state, projects out of the urinal 2. It is therefore the case that the flushing valve 13 and pipe section 12 in the cavity are mounted so as to be safeguarded against vandalism, and a person using the urinal can be detected to good effect by the detecting sensor 11.

As an alternative, it is also possible for the control element to be a time-control means which emits a control signal to the flushing valve at periodic time intervals.

FIGS. 1 to 3, as already mentioned, show the urinal arrangement having the urinal 2 and the flushing device 1. The urinal 2 comprises a urinal bowl 19 and a cavity 20. The flushing device 1 is thereby arranged, at least in part, in the cavity 20. It is particularly preferred for the only parts to be projecting out of the cavity 20 to be those on which the detecting sensor 11 is mounted and the detecting sensor 11 itself.

The urinal bowl 19 opens out downwards into an outflow opening 34, which is connected to the wastewater system by way of a siphon (not illustrated). The siphon is located in the cavity 20.

In the present embodiment, the cavity 20 is accessible via an inspection opening 21. In the preferred embodiment, the inspection opening 21, in the installed position, is arranged beneath the urinal bowl 19. A lower periphery 22 of the inspection opening 21, in the installed position, is located preferably in the horizontal. In other words, the inspection opening 21 is arranged in the lower region of the urinal 2 and the detecting sensor 11 detects essentially a user's legs. Arranging the control unit 4 in the lower region of the urinal has the advantage that it is not readily visible from the outside. Nevertheless, however, the control unit 4 is very readily accessible, because the region beneath the urinal usually remains free. Furthermore, the fitter can readily remove the control unit 4 because it is designed in one single part. There is therefore no need for any laborious manipulation of the urinal from beneath.

The connection unit 3 is fixed to the urinal 2. The control unit 4 here is connected in an interchangeable manner to the connection unit 3. There is no direct connection between the control unit 4 and the urinal 2. The control unit 4 is thus connected exclusively to the connection unit 3, and not to the urinal 2.

For connection between the connection unit 3 and the urinal 2, the support element 9 of the connection unit 3 preferably has a fastening element. The fastening element here is designed in the form of a fastening ring 30. The fastening ring 30 is thereby connected to the inspection opening 21. For this purpose, the fastening ring 30 has a fastening clip 31 opposite the outlet 6*b* of the connection pipe and the inlet 7*a* of the flushing pipe 7. The fastening ring 30 encloses an opening 32. The control unit 4 can be pushed into the cavity 20 of the urinal 2 via said opening 32. The fastening ring 30 encloses the inspection opening 21, which is arranged in the urinal 2, and access to the interior is created through the opening 32.

The said opening 32 here has a cross section which corresponds essentially to the outer shape of the support element 10 of the control unit 4. The support element 10 therefore essentially closes the inspection opening.

Figure 5:
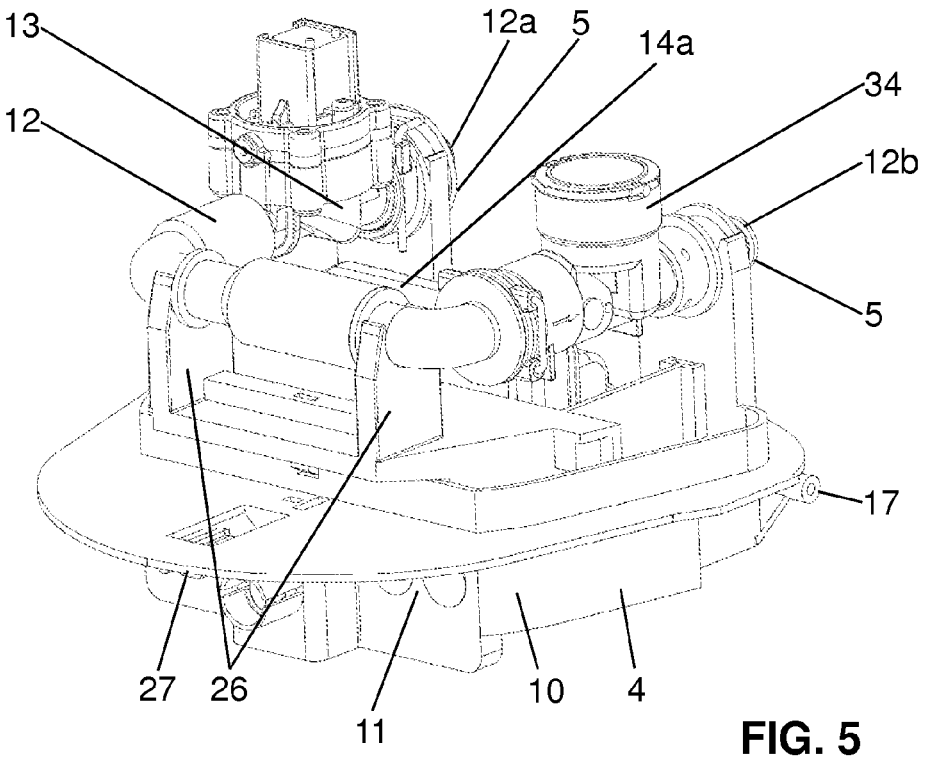
FIG. 5 shows a perspective view of a control unit according to a first embodiment.
Figure 6:
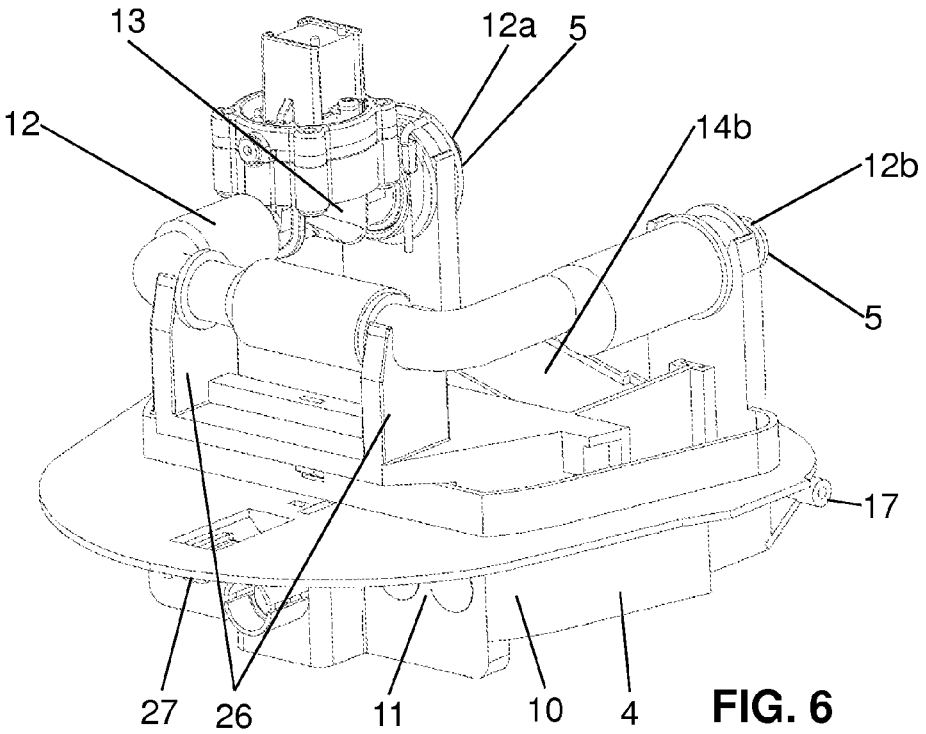
FIG. 6 shows a perspective view of a control unit according to a second embodiment.

The power-supply element 14 may be designed in various ways. In a first embodiment, the power-supply element 14 is designed in the form of a battery 14*a*, which is fed via a turbine 34 or via a power-supply unit. The turbine is arranged in the pipe section. This embodiment is illustrated in FIGS. 4 and 5. In the case of a battery changeover, the fitter changes over the control unit 4 preferably directly, which can take place very efficiently. In an alternative embodiment, the power-supply element 14 comprises a power-supply unit 14*b* which is connected to a connection cable, wherein the connection cable can be connected to a public electricity network. In a third embodiment, the power-supply element 14 comprises a turbine arranged in the pipe section.

In respect of the variant having the power-supply unit, the connection unit 3 further comprises a power-supply cable with an electrical plug-in connector. The connection cable and plug-in connector are not shown in the figures. The plug-in connector is thereby fastened on the support element 9 of the connection unit 3. The control unit 4 comprises a plug-in connector which is designed to complement the said plug-in connector and is intended for electrical connection to the plug-in connector of the connection unit 3, wherein the plug-in connector is mounted on the support element 10 of the control unit 4. The plug-in connectors on the connection unit 3 and on the control unit 4 are thereby arranged parallel to the outlet 6*b* of the connection pipe 6, the inlet 7*a* of the flushing pipe 7 and/or to the inlet 12*a* or outlet 12*b* of the pipe section 12, respectively. It is thus possible for the control unit 4, in one movement, to provide both a fluid connection and an electrical connection.

LIST OF DESIGNATIONS

1 Flushing device
2 Urinal
3 Connection unit
4 Control unit
5 Interface
6 Connection pipe
  6*a* Inlet
  6*b* Outlet
7 Flushing pipe
  7*a* Inlet
  7*b* Outlet
8 Nozzle arrangement
9 Support element of the connection unit
10 Support element of the control unit
11 Control element, detecting sensor
12 Pipe section
  12*a* Inlet
  12*b* Outlet
13 Flushing valve
14 Power-supply element
  14*a* Battery
  14*b* Power-supply unit
15 Securing element
16 Receiver
17 Pin
18 Arresting element
19 Urinal bowl
20 Cavity
21 Inspection opening
22 Lower periphery
23 Sealing ring
24 Hose
25 Stop valve
26 Mounting elements
27 Receiver
28 Upper side
29 Underside
30 Fastening ring
31 Fastening clip
32 Opening
33 Bearing location
34 Turbine
35 Restrictor

The invention claimed is:

1. A flushing device for a urinal, comprising:
a connection unit,
a control unit, and
an interface,
wherein the connection unit is configured to be fixed to the urinal and the control unit is configured to be connected to the connection unit via said interface,
wherein the connection unit comprises a connection pipe with an inlet, for connection to a mains system, and an outlet, a flushing pipe with an inlet and an outlet for connection to a nozzle arrangement for discharging flushing water into the urinal bowl of the urinal, and a support element on which the outlet of the connection pipe and the inlet of the flushing pipe are mounted in a fixed position, wherein the control unit comprises a support element on which are arranged at least one control element, a pipe section with an inlet and an outlet and also a flushing valve, which is arranged between the inlet and outlet and has a power-supply element, wherein said interface is provided by the outlet of the connection pipe and by the inlet of the flushing pipe, on the part of the connection unit, and by the inlet and the outlet of the pipe section, on the part of the control unit, and wherein the inlet of the pipe section is configured to be connected to the outlet of the connection pipe, and the outlet of the pipe section is configured to be connected to the inlet of the flushing pipe.

2. The flushing device according to claim 1, wherein the outlet of the connection pipe, the inlet of the flushing pipe, and the inlet and the outlet of the pipe section run parallel to one another, and wherein the distance between the outlet of the connection pipe and the inlet of the flushing pipe is equal to the distance between the inlet and the outlet of the pipe section.

3. The flushing device according to claim 1, wherein the flushing device comprises a securing element, by means of which the control unit is arrested mechanically in relation to the connection unit.

4. The flushing device according to claim 3, wherein the securing element is a securing lever which is mounted on the connection unit or on the control unit and has at least one receiver, which interacts with at least one pin arranged on the other unit.

5. The flushing device according to claim 4, wherein the receiver has a curved track which, upon actuation of the securing lever, subjects the control unit to an installation force, and therefore said control unit is connected to the connection unit and/or released.

6. The flushing device according to claim 3, wherein the securing element comprises an arresting, by means of which the securing element is secured in an arresting position.

7. The flushing device according to claim 1, wherein the connection unit further comprises a power-supply cable with an electrical plug-in connector, wherein the plug-in connector is fastened on the support element, and wherein the control unit likewise comprises a plug-in connector for electrical connection to the plug-in connector of the connection unit, wherein the plug-in connectors run parallel to the outlet of the connection pipe, the inlet of the flushing pipe and/or to the outlet or the inlet of the pipe section.

8. The flushing device according to claim 1, wherein the connection pipe comprises a nonreturn valve which, upon removal of the control unit, is closed by a spring pressure.

9. The flushing device according to claim 1, wherein the outlet of the connection pipe and the inlet of the pipe section have a coupling, and/or wherein the inlet of the flushing pipe and the outlet of the pipe section have a coupling, the respective parts being connected to one another via said couplings.

10. The flushing device according to claim 9, wherein the coupling comprises in each case two pipe sections assigned to the elements which are to be connected, wherein one of the pipe sections projects into the other pipe section, and wherein a sealing ring is arranged between the pipe sections.

11. The flushing device according to claim 1, wherein the pipe section and the flushing valve are arranged on an upper side of the support element, and wherein the control element is arranged on an underside of the support element.

12. The flushing device according to claim 1, wherein the power-supply element is a battery or a power-supply unit, which is connected to the connection cable, or a turbine arranged in the pipe section.

13. A urinal arrangement comprising a urinal having a urinal bowl and a cavity, and also comprising a flushing device according to claim 1, wherein the flushing device is arranged, at least in part, in the cavity.

14. The urinal arrangement according to claim 13, wherein the cavity is accessible via an inspection opening which, in the installed position, is located beneath the urinal bowl.

15. The urinal arrangement according to claim 13, wherein the connection unit is fixed to the urinal, and wherein the control unit is connected in an interchangeable manner to the connection unit.

16. The urinal arrangement according to claim 13, wherein, with the control unit being installed, the control element projects out of the inspection opening.

17. The flushing device according to claim 11, wherein the control element is a detecting sensor for detecting a user.

18. The urinal arrangement according to claim 14, wherein a lower periphery of the inspection opening, in the installed position, is located in the horizontal.

19. The urinal arrangement according to claim 16, wherein the control element is a detecting sensor.

20. The flushing device according to claim 1, wherein the connection unit and the control unit are two separate units which are connectable with each other.

* * * * *